US005488395A

United States Patent [19]

Takayanagi et al.

[11] Patent Number: 5,488,395

[45] Date of Patent: Jan. 30, 1996

[54] LIQUID JET RECORDING APPARATUS

[75] Inventors: Yoshiaki Takayanagi; Asao Saito; Ryoichi Koizumi, all of Yokohama, Japan

[73] Assignee: Canon Kabushiki Kaisha, Tokyo, Japan

[21] Appl. No.: 304,205

[22] Filed: Sep. 12, 1994

Related U.S. Application Data

[63] Continuation of Ser. No. 707,945, May 28, 1991, abandoned, which is a continuation of Ser. No. 452,499, Dec. 19, 1989, abandoned.

[30] Foreign Application Priority Data

Dec. 20, 1988 [JP] Japan ..... 63-321505

[51] Int. Cl.[6] ..... B41J 2/195

[52] U.S. Cl. ..... 347/7; 73/304 R

[58] Field of Search ..... 347/6, 7, 19, 86, 347/87; 101/364, 366, DIG. 45; 73/304 R, 304 C

[56] References Cited

U.S. PATENT DOCUMENTS

| | | | |
|---|---|---|---|
| 4,196,625 | 4/1980 | Kern | 347/7 X |
| 4,202,267 | 5/1980 | Heinzl et al. | 347/7 X |
| 4,368,478 | 1/1983 | Koto | 346/140 R |
| 4,380,019 | 4/1983 | Steinberger et al. | 347/7 |
| 4,422,084 | 12/1983 | Saito | 347/7 |
| 4,475,116 | 10/1984 | Sicking et al. | 347/7 X |
| 4,551,734 | 11/1985 | Causley et al. | 347/7 X |
| 4,788,861 | 12/1988 | Lichti | 73/304 R |
| 4,819,012 | 4/1989 | Kiyohara et al. | 347/30 |

FOREIGN PATENT DOCUMENTS

| | | |
|---|---|---|
| 58-41450 | 9/1983 | Japan . |
| 60-2369 | 1/1985 | Japan . |
| 60-141566 | 7/1985 | Japan . |
| 62-156964 | 7/1987 | Japan . |
| 62-263059 | 11/1987 | Japan . |
| 63-295266 | 12/1988 | Japan . |

*Primary Examiner*—Benjamin R. Fuller
*Assistant Examiner*— John E. Barlow, Jr.
*Attorney, Agent, or Firm*—Fitzpatrick, Cella, Harper & Scinto

[57] ABSTRACT

A liquid jet recording apparatus includes an ink container. A pair of electrodes are provided to be immersed in the ink in the container. By applying a voltage between the electrodes, the remainder of the ink is detected by a change in the electric resistance between the electrodes. The voltage application is not continuous but is intermittent and is performed at a predetermined time associated with the recording operation (at the time of carriage reversal) to detect the remainder of the ink. When the ink remainder detecting operation is not performed, the voltage is not applied to the electrodes. During a stand-by period the execution of the remainder of ink detection process is carried out only once to prevent degradation of the ink caused by electrolysis.

48 Claims, 4 Drawing Sheets

LIQUID JET RECORDING APPARATUS

This application is a continuation of application Ser. No. 07/707,945 filed May 28, 1991, now abandoned, which in turn is a continuation of application Ser. No. 07/452,499 filed Dec. 19, 1989, now abandoned.

FIELD OF THE INVENTION AND RELATED ART

The present invention relates to a liquid jet recording apparatus.

Generally, a liquid jet recording apparatus includes an ink storage such as an ink container containing recording liquid (ink), and when the container becomes short of liquid or when it becomes empty due to the consumption of liquid, the liquid is resupplied. The resupply may be accomplished by injecting the liquid or by exchanging a cartridge, when the container is in the form of a cartridge.

In order to detect the remaining amount of the ink, a pair of electrodes immersed in the ink is provided in the ink supply system, that is, the ink container or the ink supply passage, and a voltage is applied between the electrodes. With the decrease of the remaining amount of ink the electric resistance between the electrodes changes, in response to which the remaining amount of the ink can be detected.

However, if the voltage is always applied for detecting the remaining amount, the composition of the ink may be changed by electrolysis with the result that the quality of the record is degraded or there occurs a liability that the ejection outlets of the recording head become clogged.

SUMMARY OF THE INVENTION

Accordingly, it is a principal object of the present invention to provide a liquid jet recording apparatus wherein the ink is prevented from deteriorating by the ink remainder detecting operation.

It is another object of the present invention to provide a liquid jet recording apparatus provided with an ink remainder detecting means for detecting the remainder of the ink by electric power application, wherein the electrolysis of the ink is suppressed.

It is a further object of the present invention to provide a liquid jet recording apparatus wherein the degrading of the record attributable to the shortage of the ink is assuredly prevented.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the preferred embodiments of the invention will be described in detail.

Figure 1:
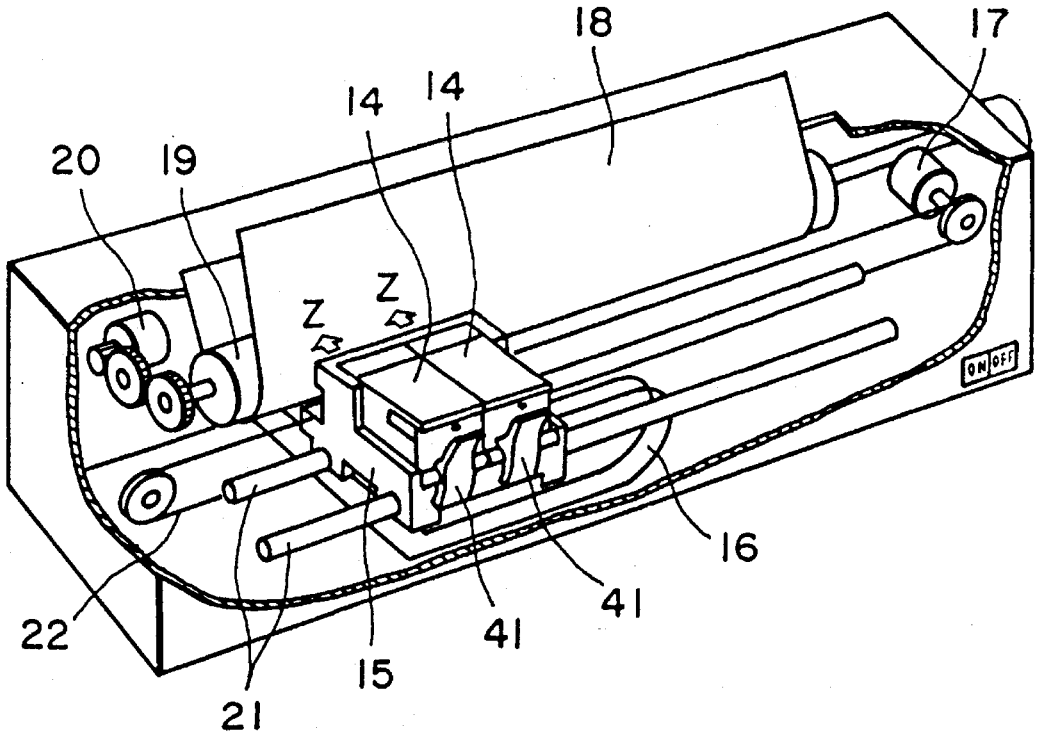
FIG. 1 is a perspective view of a liquid jet recording apparatus according to an embodiment of the present invention.

FIG. 1 shows a liquid jet recording apparatus (ink jet recording apparatus) according to a first embodiment of the present invention. The recording apparatus comprises a head cartridge 14 which includes a recording head chip provided with ink ejection outlets and ejection energy generating elements associated with the respective ejection outlets, and an ink container which is the ink supply source, as a unit. The head cartridge 14 is fixed on a carriage 15 by a confining member 41, and they are reciprocable in a longitudinal direction along a shaft 21. The ink ejected from the ejection outlet of the recording head chip reaches a recording material 18 which has a recording surface confined by a platen 19 disposed so that it is spaced from the ejection outlet with a small clearance, by which an image is formed on the recording material 18.

To the ejection energy generating elements (electrothermal transducer elements, for example) of the recording head chip, ejection signals corresponding to image data to be recorded are supplied from a suitable data supply source through a cable 16 and contacts connected therewith. The number of head cartridges 14 may be one or more (two in FIG. 1) in accordance with the number of colors to be used.

The recording apparatus further comprises a carriage motor 17 for reciprocating the carriage 15 along the shaft 21, a wire 22 for transmitting the driving force from the motor 17 to the carriage 15, and a feed motor operatively connected with the platen roller 19 to feed the recording medium 18.

Figure 2:
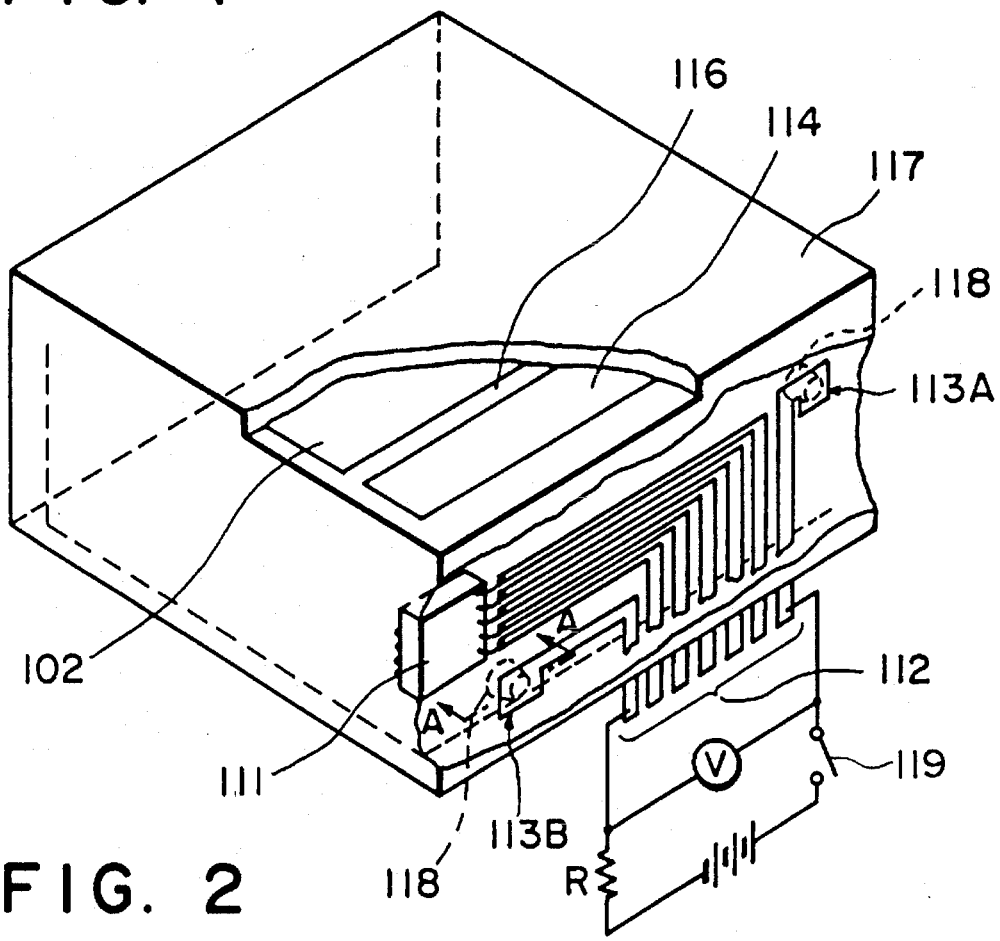
FIG. 2 is a perspective view of an example of a recording head (head cartridge) used with the liquid jet recording apparatus of this embodiment.

FIG. 2 shows the structure of the head cartridge 14. The head cartridge comprises a recording head chip 111, a wiring member (lead frame) including a plate like conductor for providing electric connection between the recording head chip 111 and the main assembly of the liquid jet recording apparatus by wiring bonding or the like, ink remainder detecting electrodes 113A and 113B built in the lead frame 112 to detect the ink remainder which will be described in detail hereinafter, an ink passage for supplying ink from the ink container 102 to the recording head chip 111, a partition wall 116 for dividing the ink container 102 and the ink supply passage 114. Designated by a reference numeral 119 is a switch which is on-off-controlled by a controller shown in FIG. 6 which will be described hereinafter.

Figure 3:
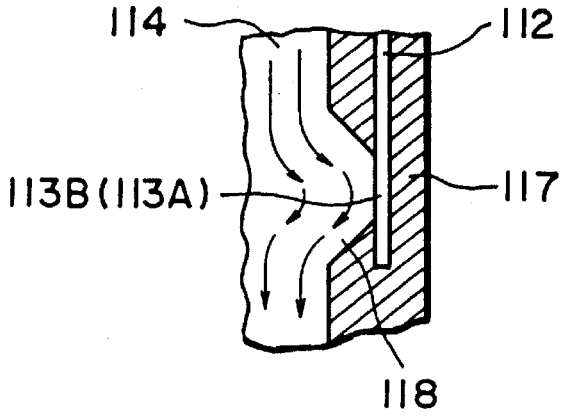
FIG. 3 is a sectional view taken along line A—A to illustrate the structure of the ink remainder detecting portion.

FIG. 3 shows an example of the detecting electrodes. The lead frame 112 is embedded in a casing 117 made of plastic resin, for example, of the head cartridge which is constituted by the unified ink container 102 and the recording head chip 111. Only the ink remaining amount detecting electrodes 113A and 113B are exposed to the ink supply passage 114 through a conductive portion 118. When the switch 119 is closed, electric power is supplied between the electrodes through a resistance R.

Figure 4:
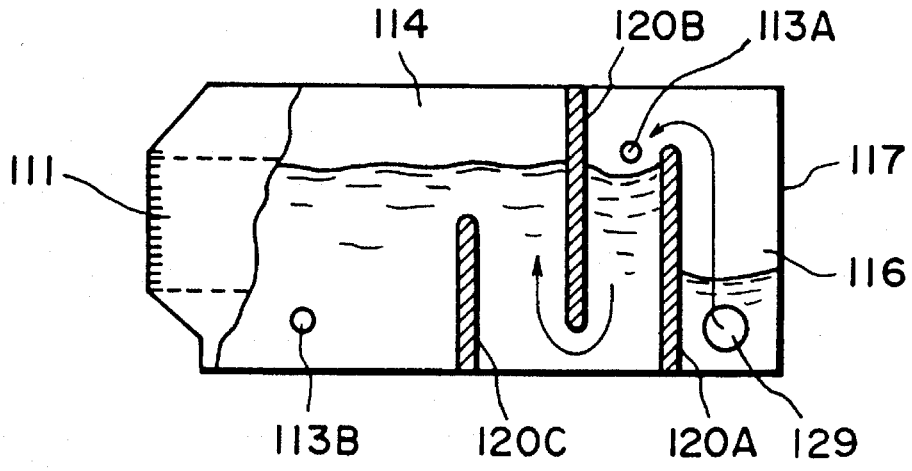
FIG. 4 is schematic view illustrating the ink supply passage in this embodiment.

As shown in FIG. 4, the ink supply passage 114 is provided with an ink supply port 129 formed in the partition wall 116, and the ink supply passage 114 is provided with ribs 120A, 120B and 120C extended alternately from the top and the bottom.

The ink introduced into the supply passage 114 through the ink supply port 129 from the ink container 102 is directed to the next section beyond the first rib 120A by an unshown capillary tube, and it is supplied to the recording head chip 111 through the path indicated by an arrow. Upon performing the recording operation, the ink is ejected through the ejection outlets. When the ink container 102 becomes empty, so that the ink is not introduced into the ink passage 114, the liquid surface level becomes that shown in FIG. 4, so that the ink remainder detecting portion 113A is exposed above the liquid surface level with the result that the electrical connection between the detecting portions 113A and 113B is revered.

Figure 5:
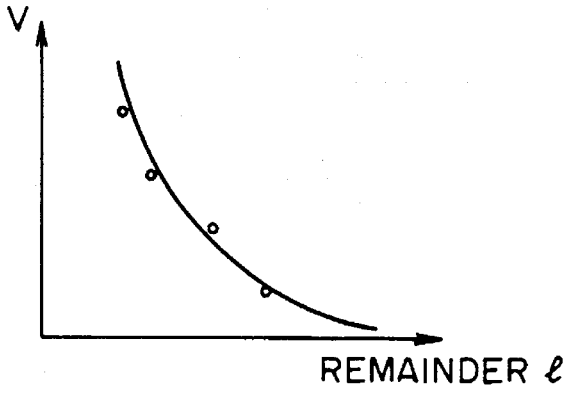
FIG. 5 is a graph of a voltage vs. a remaining amount of the ink, under the condition that the current flowing between the detecting electrodes is maintained constant.

By the absence of the electric current, the reaching of the ink remainder to the limit is detected. The electric current flows more or less, as long as the coat of the conductive ink remains between the detecting electrodes. Therefore, where the detecting circuit is so constituted that a constant current flows, there is a relationship as shown in FIG. 5 between the voltage V and the ink remainder 1. Therefore, it is possible to detect the amount of the ink remainder 1.

In this embodiment, the remainder detecting operation is performed only at a predetermined timing during the recording operation and the stand-by state, and otherwise, the switch 119 is opened.

Figure 6:
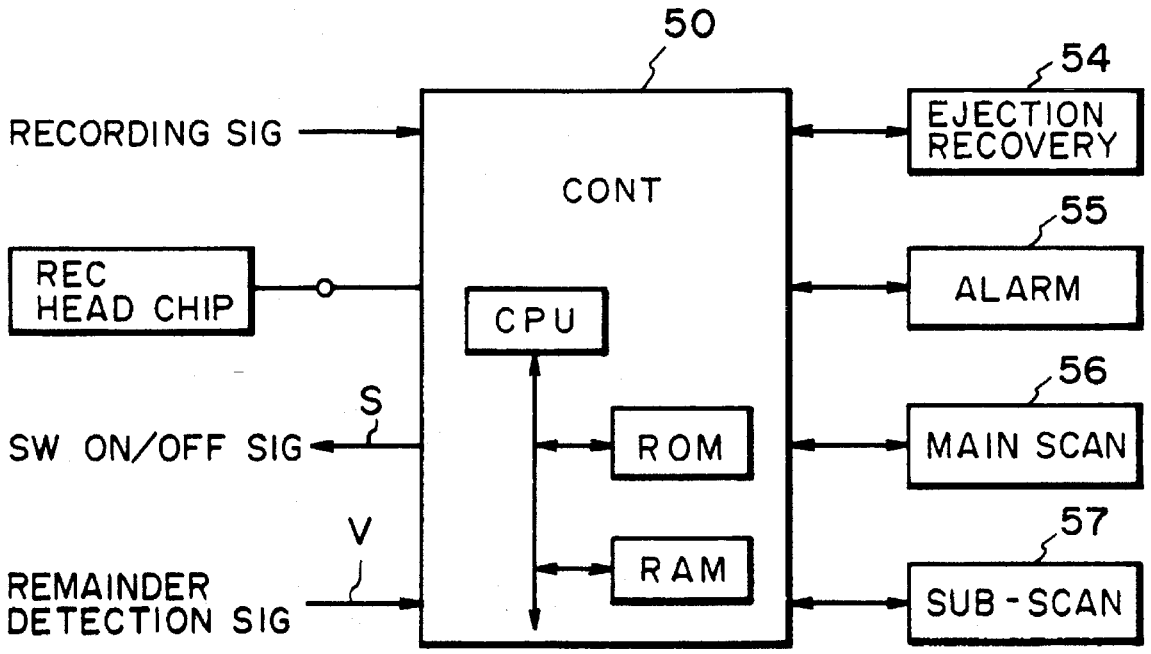
FIG. 6 is a block diagram of an example of a control system for detecting the remaining ink.

FIG. 6 shows an example of the control system for this embodiment. The control system includes a controller 50 which is the main controlling section and which includes a CPU for executing the process steps which will be described in conjunction with FIGS. 7 and 8, ROM storing programs executing the process steps and other fixed data, a RAM including a working area such as flag, and a power supply device (not shown) for supplying electric power to the heater or the like.

In FIG. 6, reference V indicates a remainder detection signal from the remainder detector shown in FIG. 2, and S is a control signal for closing and opening the switch 119. The remainder detection signal V is inputted only when the switch 119 is closed by which a voltage is applied between the electrodes 113A and 113B.

There is a recording head chip (111) in the head cartridge of a disposable type, as shown in FIG. 2. An ejection recovery device 54 includes a capping device selectively opposed to or engaged with the recording head chip outside the recording range (FIG. 1), for example, at a home position of the recording head or the carriage 15, and it also includes a sucking mechanism communicating with the capping device to suck the ink out of the recording head through the ejection outlets.

The control system further includes an alarming device 55 including a display such as LED or a sound generator such as a buzzer or a combination thereof. A main scanning mechanism 56 functions to scanningly move the carriage 15 during the recording operation, and it includes the motor 17 or the like. A subordinate scanning mechanism 57 includes the motor 20 or the like for conveying the recording material.

Figure 7:
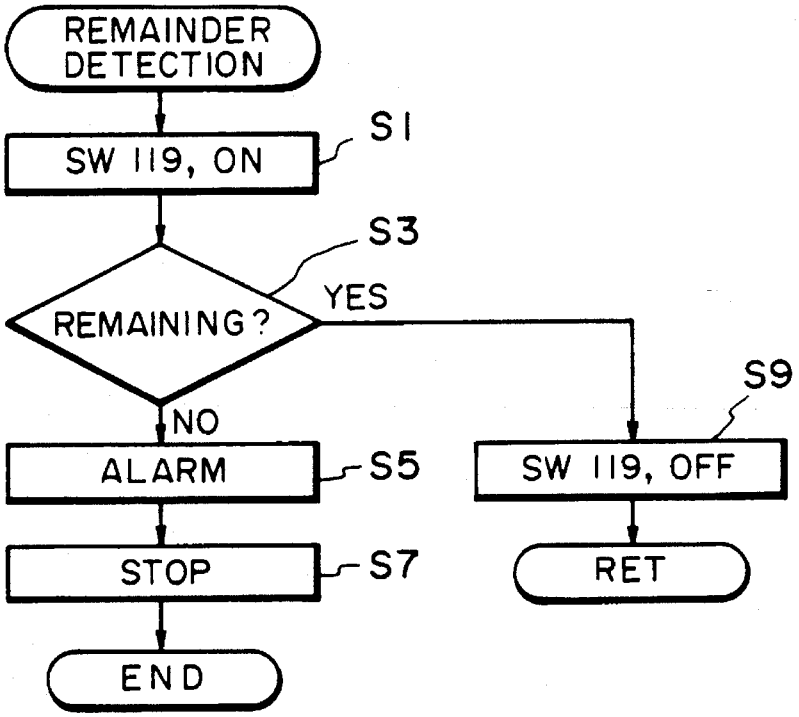
FIG. 7 is a flow chart illustrating an example of the control steps for the remainder detection.

FIG. 7 shows an example of the ink remainder detecting process steps in this embodiment, and it is started during the recording operation or during the stand-by state.

When this process is started, the switch 119 is closed at step S1, by which a voltage is applied between the electrodes 113A and 113B of the head cartridge 14. At step S3, a discrimination is made as to whether or not the ink remains on the basis of the voltage V between the electrodes (remainder detection signal) V produced by the voltage application.

If the result of the discrimination is negative, step S5 is executed by which an alarm indicating the absence of the ink is actuated to prompt the operator to supply ink or exchange the head cartridge 14, and at step S7, various parts of the apparatus are stopped, and the apparatus waits for the exchange of the head cartridge 14 or the like.

On the other hand, if the result of the discrimination at step S3 is affirmative, a step S9 is executed by which the switch 119 is opened to stop the voltage application between the electrodes 113A and 113B to shut the electric current through the ink.

Figure 8:
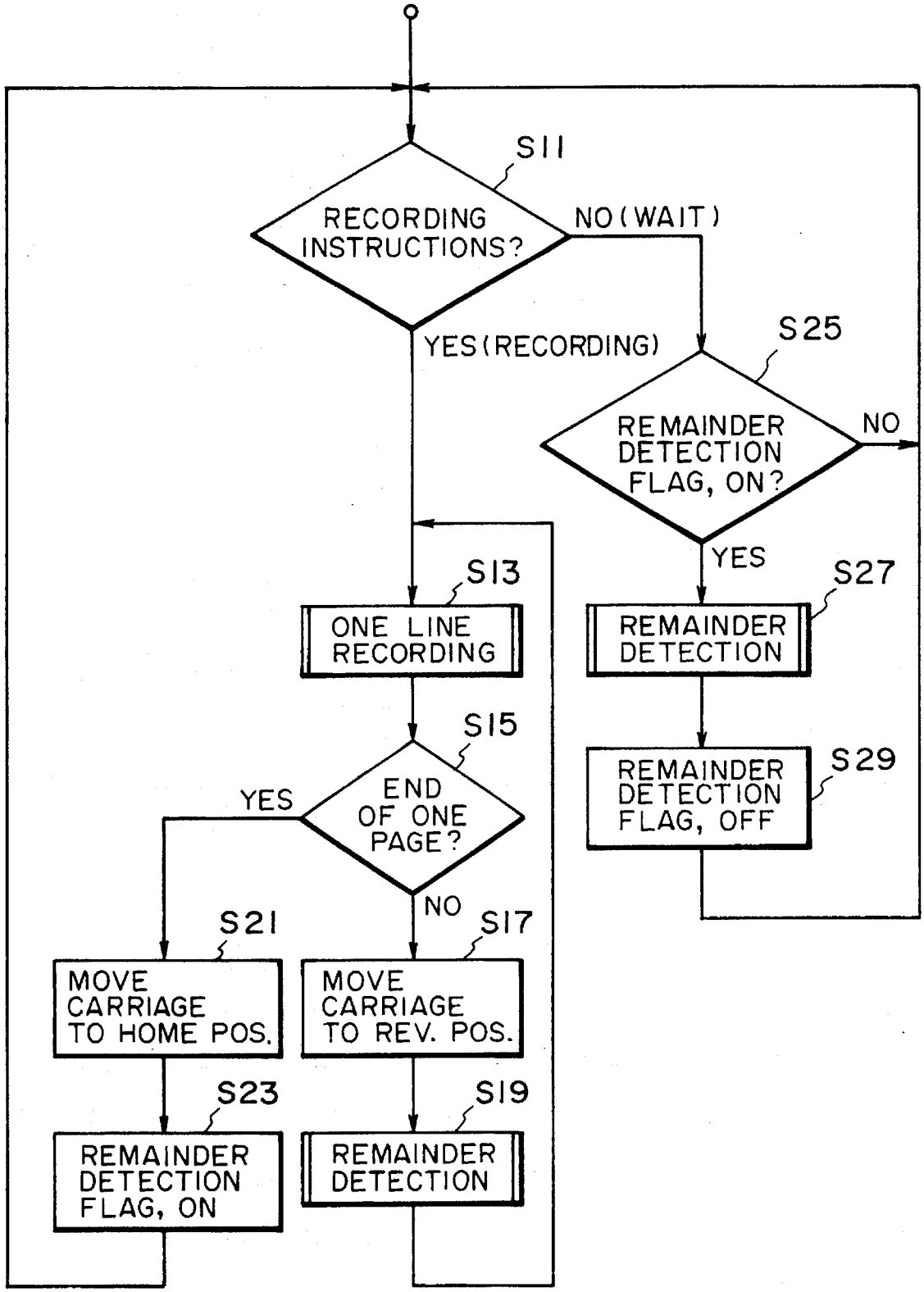
FIG. 8 is a flow chart showing an example of the process steps during the recording and during a stand-by state of the apparatus.

FIG. 8 shows an example of the process steps executed during the recording operation and the stand-by state in the liquid jet recording apparatus of this embodiment.

At step S11, the discrimination is made as to whether the record instruction signal is produced or not. In response to the discrimination, either of the recording process (step S13) or the stand-by process is performed (step S25).

At step S13, the data corresponding to one line to be recorded by one main scan of the recording head chip is obtained from a predetermined amount (one page, for example) of image data developed in the RAM in the controller 50, for example, and the data are aligned in a buffer. Then, the ejection energy generating elements on the recording head chip are selectively actuated in accordance with the image data, while driving the main scanning mechanism 56, to perform the recording on one line. After the recording of one line, the subordinate scanning mechanism 57 is driven to feed the recording material 18 through a predetermined distance.

When the one line recording is completed, a step S15 is performed in which a discrimination is made as to whether the one line data are all recorded or not. If not, a step S17 is performed to return the carriage 15 to a predetermined reversing position (the record starting position for the next line or adjacent thereto) to be prepared for the next line printing. At step S19, the remainder detection process shown in FIG. 7 is performed. Thereafter, the operation returns to step S13 for performing the next line recording.

If the result of the discrimination at step S15 is affirmative, a step S21 is executed to set the carriage 15 to the home position to be prepared for the next recording operation, and the ejection recovery device 54 is opposed to the recording head chip and to engage the cap thereto. At step S23, a remainder detecting flag is set, which can be disposed at a predetermined address of the RAM of the controller 50, for example, representing whether the remainder detection is to be performed or not during the stand-by state, and the operation returns to the step S11.

During the stand-by state, the discrimination is first made as to whether or not the remainder detection flag is set, at step S25. If it is immediately after the previous recording operation, the result of the discrimination is affirmative. At step S27, the remainder detecting process shown in FIG. 7 is performed, and thereafter, at step S29, the remainder detecting flag is reset, and the operation returns to the step S11. If, on the other hand, the result of the discrimination at the step S25 is negative, the operation immediately returns to the step S11.

As described, the remainder detection is performed only once during the stand-by state in preparation for the next recording operation, whereby the voltage is applied between the electrodes 113A and 113B only during that period, and therefore, the inconveniences attributable to the electrolysis of the ink can be remarkably reduced.

During the recording operation, the remainder detection is carried out only at a proper timing, and therefore, as compared to conventional devices the ink remainder is monitored by always applying the voltage, and the above inconveniences can be reduced. In addition, the problem arising from the remainder detection performed only during the stand-by state, that is, the ink comes out during the recording operation with the result of improper recording, can be prevented.

In the foregoing embodiment, remainder detection is performed each time one line recording is performed, but it may be carried out each time several lines are recorded. Where the CPU is not involved during the movement of the carriage in reverse to a previous position, the remaining amount of the ink can be detected during the movement of the carriage in reverse to the previous position. Further, where the CPU is not involved during the recording operation by the main scanning mechanism 56 and the recording head, remainder detection may be performed during the movement of the carriage.

In these cases, remainder detection can be started by interruption using a timer. Furthermore, an additional CPU may be provided to perform the above process, so that these processes are performed independently.

In the foregoing description, the liquid jet recording apparatus is of such a type that the recording head chip and the ink container constitute a unified head cartridge. However, the present invention is applicable to the case wherein they are separate. Also, the recording head chip is not necessarily disposable. In this case, the ink container may be disposed at any place. It does not need to be a disposable cartridge, but it may be of the type wherein the ink is supplied by injection or the like.

In the foregoing description, the ink remainder detection system is used also for discriminating the properness of the ink, but they may be separate means.

In addition, the foregoing description has been provided with respect to a serial type liquid jet recording apparatus in which the recording head is scanningly moved relative to the recording medium, but the present invention is very effectively and easily usable with a so-called multi-type recording apparatus wherein a number of the ejection outlets are used to cover the entire width of the recording material.

As described in the foregoing, in an ink jet recording apparatus wherein the remainder of the ink is detected by applying a voltage between electrodes immersed in the ink, the remainder detecting operation is performed by the application of the voltage only at a predetermined time, and therefore, electrolysis of the ink, which results if the voltage is always applied, can be remarkably suppressed. In addition, the remainder detecting operation is performed in association with the recording operation, and therefore, the shortage or lack of ink is quickly detected, and therefore, the deterioration of the quality of recording performing attributable to recording operation with a shortage or a lack of ink, can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus, comprising:

a recording head having ejection outlets for ejecting ink;

ink supply means for supplying the ink to said recording head;

an element for receiving electrical power when detecting a remaining amount of the ink in said ink supply means;

control means for supplying electrical power to said element to detect the ink remaining in said ink supply means, wherein said control means permits supply of electrical power to said element when a remainder detection instruction is set, and prevents supply of electrical power to said element when said remainder detection instruction is not set;

setting means for setting the remainder detection instruction to permit an ink remainder detecting operation in a stand-by state; and resetting means for resetting the remainder detection instruction in response to execution of the ink remainder detecting operation in the stand-by state so that the remainder detection instruction is not set.

2. An apparatus according to claim 1, wherein said control means supplies electrical power to said element each time said recording head has completed recording one page.

3. An apparatus according to claim 2, further comprising a carriage for reciprocating said recording head in predetermined directions relative to a recording material during a recording operation, wherein said control means supplies electrical power to said element when said recording head reaches a predetermined position by moving in a direction opposite to the direction of movement of said recording head while ejecting ink.

4. An apparatus according to claim 2, wherein said control means supplies electrical power to said element after said recording head reaches a predetermined stop position after completion of recording of one page.

5. An apparatus according to claim 1, wherein said control means supplies electrical power to said element only once when said apparatus is in a stand-by state.

6. An apparatus according to claim 1, wherein said recording head and said ink supply means are unified into a unit which is detachably mountable to a main assembly of said apparatus.

7. An apparatus according to claim 1, further comprising another element, wherein said elements comprise a pair of electrodes disposed in said ink supply means.

8. An apparatus according to claim 1, wherein said recording head includes electrothermal transducer elements to eject the ink by thermal energy.

9. An apparatus according to claim 2, wherein said recording head includes electrothermal transducer elements to eject the ink by thermal energy.

10. An apparatus according to claim 3, wherein said recording head includes electrothermal transducer elements to eject the ink by thermal energy.

11. An apparatus according to claim 4, wherein said recording head includes electrothermal transducer elements to eject the ink by thermal energy.

12. An apparatus according to claim 4, wherein said control means supplies electrical power to said element only once after said recording head reaches the predetermined stop position after completion of recording of one page.

13. An apparatus according to claim 12, wherein said recording head includes electrothermal transducer elements to eject the ink by thermal energy.

14. An apparatus according to claim 5, wherein said recording head includes electrothermal transducer elements to eject the ink by thermal energy.

15. An apparatus according to claim 6, wherein said recording head includes electrothermal transducer elements to eject the ink by thermal energy.

16. An apparatus according to claim 7, wherein said recording head includes electrothermal transducer elements to eject the ink by thermal energy.

17. A recording apparatus for using a recording head having energy generating elements supplied with ejection signals in accordance with image data to eject ink through an ejection outlet, the apparatus comprising:

ink supply means for supplying the ink to the recording head;

an element for receiving electrical power when detecting a remaining amount of the ink in said ink supply means;

control means for supplying electrical power to said element to detect the ink remaining in said ink supply means, wherein said control means permits supply of electrical power to said element when a remainder detection instruction is set, and prevents supply of electrical power to said element when a remainder detection instruction is not set;

setting means for setting the remainder detection instruction to permit an ink remainder detecting operation in a stand-by state; and resetting means for resetting the remainder detection instruction in response to execution of the ink remainder detecting operation in the stand-by state so that the remainder detection instruction is not set.

18. An apparatus according to claim 17, wherein said recording head includes electrothermal transducer elements to eject the ink by thermal energy.

19. An apparatus according to claim 17, wherein said control means supplies electrical power to said element each time said recording head has completed recording one page of image data.

20. An apparatus according to claim 19, wherein said recording head includes electrothermal transducer elements to eject the ink by thermal energy.

21. An apparatus according to claim 19, further comprising a carriage for reciprocating said recording head in predetermined directions relative to a recording material during a recording operation, wherein said control means supplies electrical power to said element when said recording head reaches a predetermined position by moving in a direction apposite to the direction of movement of said recording head while ejecting ink.

22. An apparatus according to claim 21, wherein said recording head includes electrothermal transducer elements to eject the ink by thermal energy.

23. An apparatus according to claim 17, wherein said control means supplies electrical power to said element after said recording head reaches a predetermined stop position after completion of recording of one page of image data.

24. An apparatus according to claim 23, wherein said recording head includes electrothermal transducer elements to eject the ink by thermal energy.

25. An apparatus according to claim 23, wherein said control means supplies electrical power to said element only once after said recording head reaches the predetermined stop position after completion of recording of one page of image data.

26. An apparatus according to claim 25, wherein said recording head includes electrothermal transducer elements to eject the ink by thermal energy.

27. An apparatus according to claim 17, wherein said control means supplies electrical power to said element only once when said apparatus is in a stand-by state awaiting image data.

28. An apparatus according to claim 17, wherein said recording head includes electrothermal transducer elements to eject the ink by thermal energy.

29. An apparatus according to claim 17, wherein the recording head and said ink supply means are unified into a unit which is detachably mountable to a main assembly of said apparatus.

30. An apparatus according to claim 29, wherein said recording head includes electrothermal transducer elements to eject the ink by thermal energy.

31. An apparatus according to claim 17, further comprising another element, wherein said elements comprise a pair of electrodes disposed in said ink supply means.

32. An apparatus according to claim 31, wherein said recording head includes electrothermal transducer elements to eject the ink by thermal energy.

33. A recording apparatus wherein an image is recorded by a detachably mountable cartridge including a recording head having an energy generating element which is supplied with ejection signals in accordance with image data to eject ink through an ejection outlet, and ink supply means for supplying the ink to the recording head, the cartridge having an element for receiving electrical power when detecting a remaining amount of the ink in the ink supply means, the apparatus comprising:

power supply means for supplying electrical power to the element;

control means for supplying electrical power to the element to detect the ink remaining in the ink supply means, wherein said control means permits supply of electrical power to said element when a remainder detection instruction is set, and prevents supply of electrical power to said element when said remainder detection instruction is not set;

setting means for setting the remainder detection instruction to permit an ink remainder detecting operation in a stand-by state; and resetting means for resetting the remainder detection instruction in response to execution of the ink remainder detecting operation in the stand-by state so that the remainder detection instruction is not set.

34. An apparatus according to claim 33, wherein said control means connects said power supply means to the element each time the recording head has completed recording one page of image data.

35. An apparatus according to claim 34, wherein the recording head is reciprocated by a carriage in predetermined directions relative to a recording material during a recording operation, and wherein said control means connects said power supply means to the element when the recording head reaches a predetermined position by moving in a direction opposite the direction of movement of the recording head while ejecting ink.

36. An apparatus according to claim 34, wherein said control means connects said power supply means to the element after the recording head reaches a predetermined stop position after completion of recording of one page of image data.

37. An apparatus according to claim 36, wherein said control means connects said power supply means to the element only once after the recording head reaches the predetermined stop position after completion of recording of one page of image data.

38. An apparatus according to claim 33, wherein said control means connects said power supply means to the element only once when said apparatus is in a stand-by awaiting image data.

39. An apparatus according to claim 33, wherein the recording head and the ink supply means are unified into a unit which is detachably mountable to a main assembly of said apparatus.

40. An apparatus according to claim 33, the cartridge further comprising another element, wherein the elements comprise a pair of electrodes disposed in the ink supply means.

41. A recording apparatus for recording an image using ink supplied from ink supply means having an element for receiving electrical power when detecting a remaining amount of the ink in the ink supply means, the apparatus comprising:

a recording head having ejection outlets for ejecting ink supplied from the ink supply means;

power supply means for supplying electrical power to the element; and control means for supplying electrical power to the element, wherein said control means permits supply of electrical power to said element when a remainder detection instruction is set, and prevents supply of electrical power to said element when said remainder detection instruction is not set;

setting means for setting the remainder detection instruction to permit an ink remainder detecting operation in a stand-by state; and resetting means for resetting the remainder detection instruction in response to execution of the ink remainder detecting operation in the stand-by state so that the remainder detection instruction is not set.

42. An apparatus according to claim 41, wherein said control means connects said power supply means to the element each time the recording head has completed recording one page.

43. An apparatus according to claim 42, wherein the recording head is reciprocated by a carriage in predetermined directions relative to a recording material during a recording operation, and wherein said control means connects said power supply means to the element when the recording head reaches a predetermined position by moving in a direction opposite the direction of movement of the recording head while ejecting ink.

44. An apparatus according the claim 42, wherein said control means connects said power supply means to the element after the recording head reaches a predetermined stop position after completion of recording of one page.

45. An apparatus according to claim 44, wherein said control means connects said power supply means to the element only once after the recording head reaches the predetermined stop position after completion of recording of one page.

46. An apparatus according to claim 41, wherein said control means connects said power supply means to the element only once when said apparatus is in a stand-by state.

47. An apparatus according to claim 41, wherein said recording head and the ink supply means are unified into a unit which is detachably mountable to a main assembly of said apparatus.

48. An apparatus according to claim 41, wherein the ink supply means further comprises another element, and the elements comprise a pair of electrodes disposed in the ink supply means.

* * * * *

UNITED STATES PATENT AND TRADEMARK OFFICE

CERTIFICATE OF CORRECTION

PATENT NO. : 5,488,395

DATED : January 30, 1996

INVENTOR(S) : YOSHIAKI TAKAYANAGI ET AL.

It is certified that error appears in the above-identified patent and that said Letters Patent is hereby corrected as shown below:

COLUMN 3

Line 19, "revered." should read --severed.--.

COLUMN 5

Line 57, "performing" should be deleted.
Line 58, "to" should read --to performing a-- and "ink," should read --ink--.

COLUMN 7

Line 46, "apposite" should read --opposite--.

Signed and Sealed this

Twenty-fifth Day of June, 1996

Bruce Lehman

*Attest:*

BRUCE LEHMAN

*Attesting Officer*

*Commissioner of Patents and Trademarks*